US008585017B2

(12) United States Patent
Garceau

(10) Patent No.: US 8,585,017 B2
(45) Date of Patent: Nov. 19, 2013

(54) LOW PROFILE SCISSOR JACK

(75) Inventor: Bernard F. Garceau, Vandalia, MI (US)

(73) Assignee: Norco Industries, Inc., Compton, CA (US)

( * ) Notice: Subject to any disclaimer, the term of this patent is extended or adjusted under 35 U.S.C. 154(b) by 195 days.

(21) Appl. No.: 12/956,535

(22) Filed: Nov. 30, 2010

(65) Prior Publication Data

US 2011/0291060 A1 Dec. 1, 2011

Related U.S. Application Data

(60) Provisional application No. 61/265,357, filed on Nov. 30, 2009.

(51) Int. Cl.
*B66F 3/08* (2006.01)

(52) U.S. Cl.
USPC ..... 254/122; 254/126

(58) Field of Classification Search
USPC ..... 254/122, 123–126, 134
See application file for complete search history.

(56) References Cited

U.S. PATENT DOCUMENTS

| | | | | |
|---|---|---|---|---|
| 2,467,657 | A | 4/1949 | Brown | |
| 2,557,465 | A | 6/1951 | Rauscher | |
| 3,436,947 | A | 4/1969 | Steppon | |
| 4,055,329 | A | 10/1977 | Hammond | |
| 4,583,713 | A | 4/1986 | Fukura et al. | |
| 4,695,036 | A | 9/1987 | Yukimoto et al. | |
| 4,720,082 | A | 1/1988 | Yang | |
| 4,732,366 | A | 3/1988 | Suga | |
| 4,802,653 | A | 2/1989 | Engel | |
| 4,836,502 | A | 6/1989 | Yamauchi | |
| 5,110,091 | A | 5/1992 | Engel et al. | |
| 5,275,378 | A | 1/1994 | Alten | |
| 5,303,898 | A | 4/1994 | Engel et al. | |
| 5,307,549 | A | 5/1994 | Tsutsumi et al. | |
| 5,449,149 | A | 9/1995 | Popowich | |
| 5,529,286 | A | 6/1996 | Kikuchi | |
| 5,692,730 | A | 12/1997 | Gill | |
| 5,975,497 | A * | 11/1999 | Few et al. | 254/126 |
| 6,161,816 | A * | 12/2000 | Kikuchi | 254/126 |
| 6,334,605 | B1 | 1/2002 | Kikuchi | |
| 6,375,161 | B2 | 4/2002 | Garceau | |
| 6,527,251 | B1 | 3/2003 | Garceau | |
| 6,607,181 | B2 * | 8/2003 | Garceau | 254/126 |
| 2009/0200527 | A1 * | 8/2009 | Christie | 254/122 |
| 2010/0065795 | A1 * | 3/2010 | Christie | 254/126 |
| 2011/0291060 | A1 * | 12/2011 | Garceau | 254/122 |

* cited by examiner

*Primary Examiner* — Lee D Wilson
(74) *Attorney, Agent, or Firm* — Hahn, Loeser & Parks, LLP

(57) ABSTRACT

A scissor jack assembly may have a base member for resting the jack assembly against a supporting surface and a support bracket assembly. First and second lower arm members may each be of an open channel construction with a width extending between a pair of outer sidewalls. One end of each lower arm member may be connected to the base plate. First and second upper arm members may each be of an open channel construction having a width extending between a pair of outer sidewalls. One end of each outer one end may be connected to the support bracket assembly. First and second trunnions may connect the upper arms with the lower arms. Each of the trunnions may include a bore. A rotatable shaft member may extend into the bores of the first and second trunnions.

26 Claims, 7 Drawing Sheets

LOW PROFILE SCISSOR JACK

CROSS-REFERENCE TO RELATED APPLICATIONS

This application claims priority to U.S. provisional patent application No. 61/265,357, filed Nov. 30, 2009, the disclosure of which is incorporated by reference herein in its entirety.

BACKGROUND

Mechanical jacks used for raising heavy objects are generally known. One type of jack is the screw-operated scissor jack.

Screw-operated scissor jacks have long been known to be useful in lifting applications and especially in situations where it may be desired to level heavy objects. It is generally desirable to decrease the size and weight of a scissor jack, so long as lifting capabilities are not significantly sacrificed.

SUMMARY

The present disclosure relates to screw-operated scissor jacks. Particular embodiments include a scissor jack assembly having a base member for resting the jack assembly against a supporting surface and a support bracket assembly. First and second lower arm members may each be of an open channel construction with a width extending between a pair of outer sidewalls. One end of each lower arm member may be connected to the base plate. First and second upper arm members may each be of an open channel construction having a width extending between a pair of outer sidewalls. One end of each outer one end may be connected to the support bracket assembly. First and second trunnions may connect the upper arms with the lower arms. Each of the trunnions may include a bore. A rotatable shaft member may extend into the bores of the first and second trunnions. Each of the upper and lower arm members may taper in width as each arm generally narrows in width as it extends toward connection with either the first or second trunnion. Each of the upper and lower arm members may include one or more strengthening embossments positioned along each of its sidewalls and/or a closed channel wall. Further embodiments also provide that each of the upper and lower arm members include a plurality of teeth located at the end of each such member connecting to the base plate or said support bracket assembly. Each of the plurality of teeth may be angularly biased to a sidewall of the base plate or a sidewall of the support bracket assembly to which it is respectfully connected. Additionally, at least one reinforcing gear may be included within any of the embossments.

DETAILED DESCRIPTION

Figure 1:
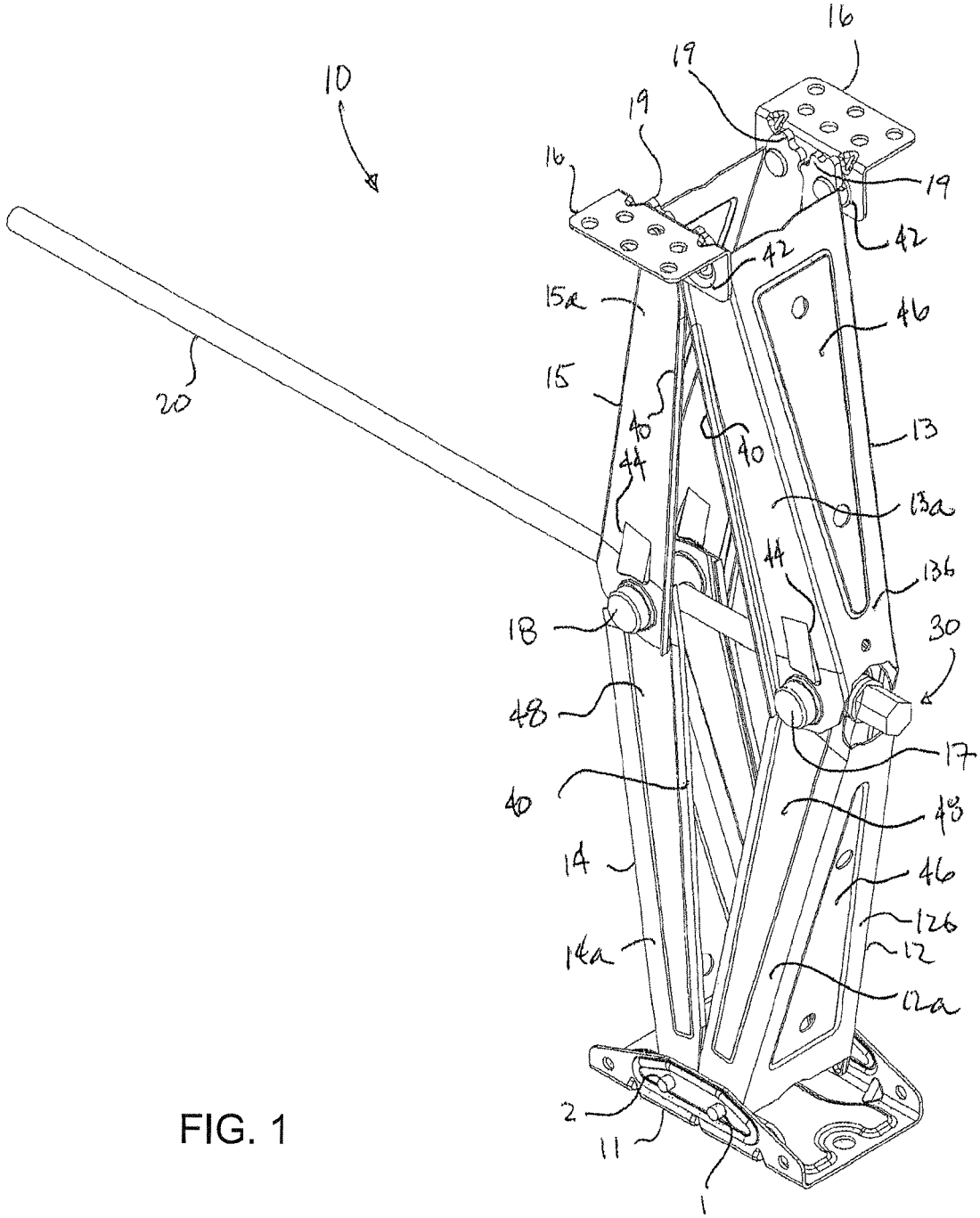
FIG. 1 is a side perspective view of a jack assembly, according to an embodiment, shown in a raised condition.
Figure 2:
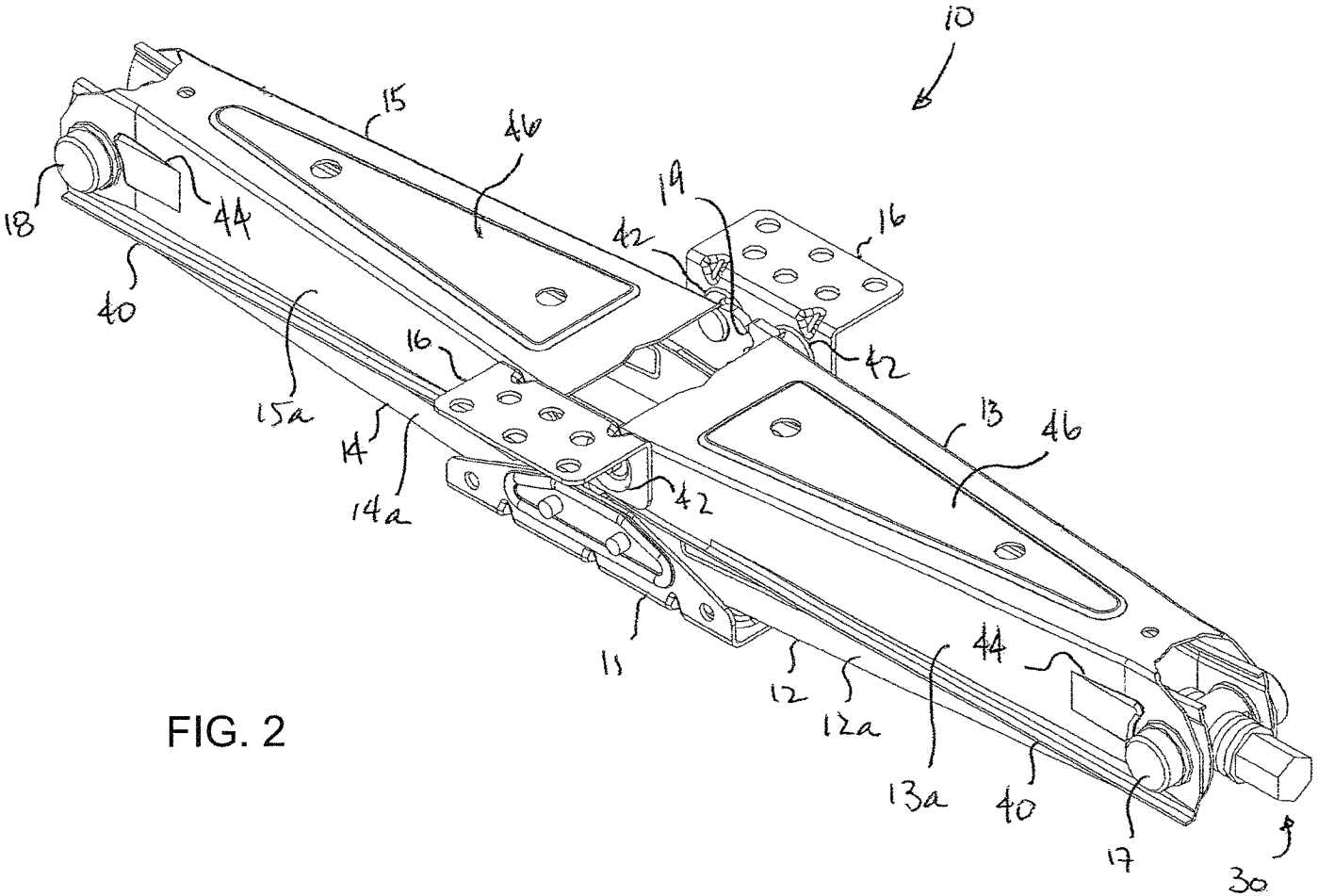
FIG. 2 is a side perspective view of the jack assembly of FIG. 1, shown in a collapsed condition.
Figure 3:
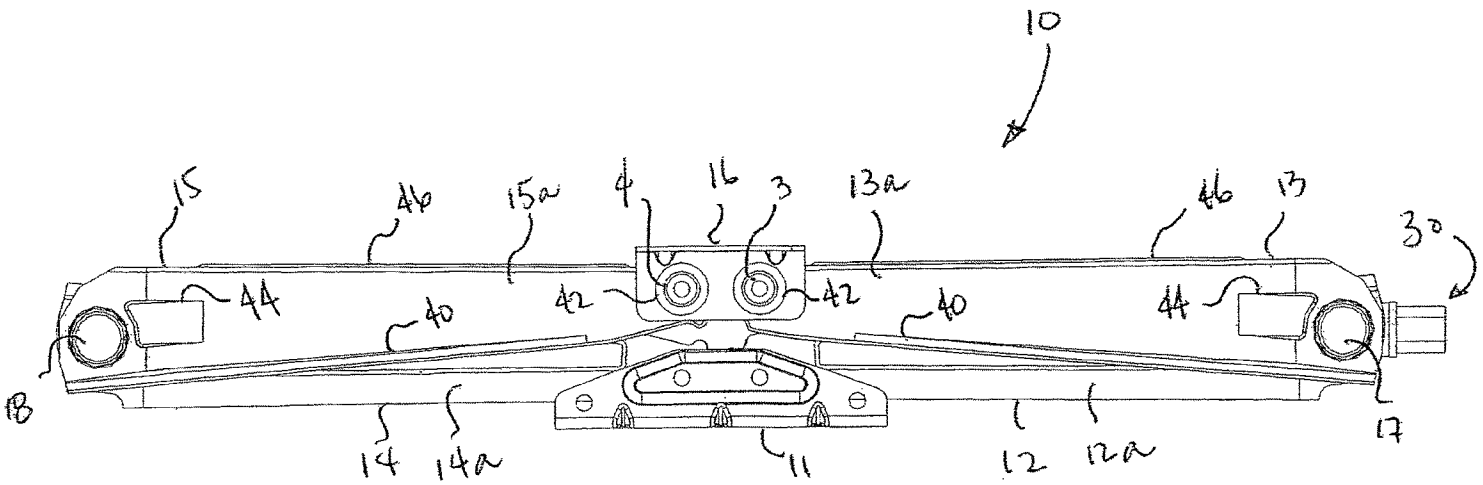
FIG. 3 is a side view of the jack assembly shown in FIG. 2.
Figure 4:
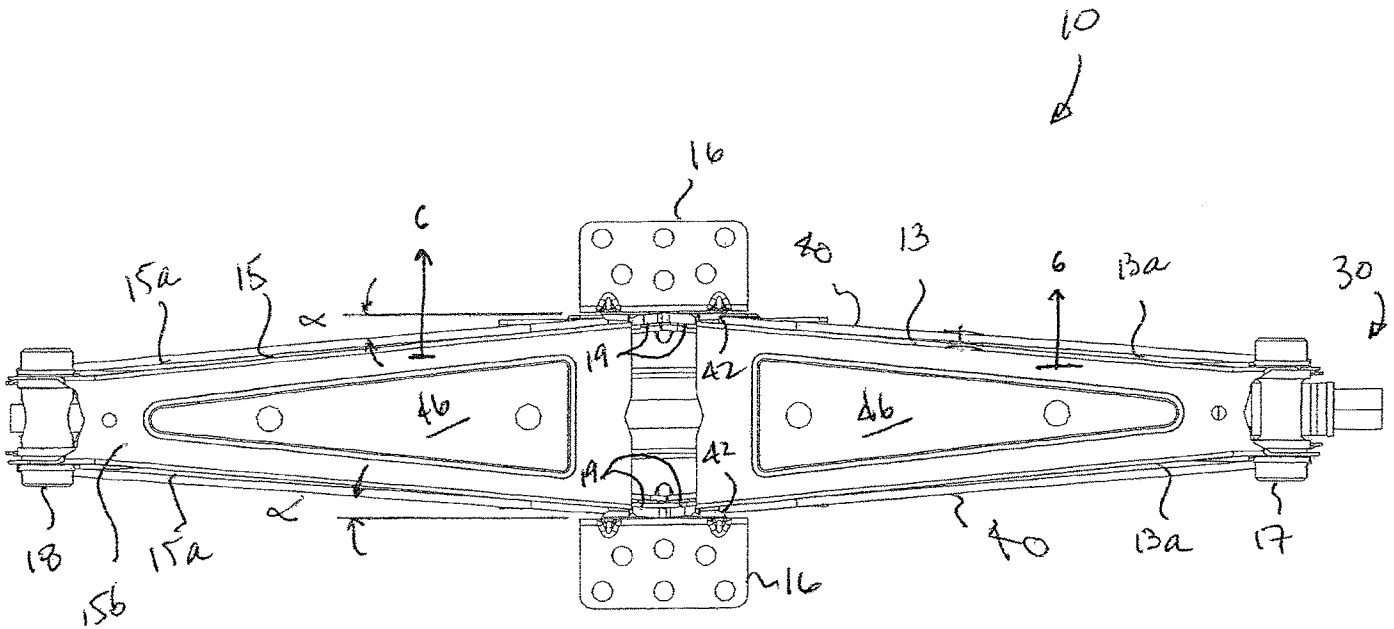
FIG. 4 is a top view of the jack assembly shown in FIG. 2.
Figure 5:
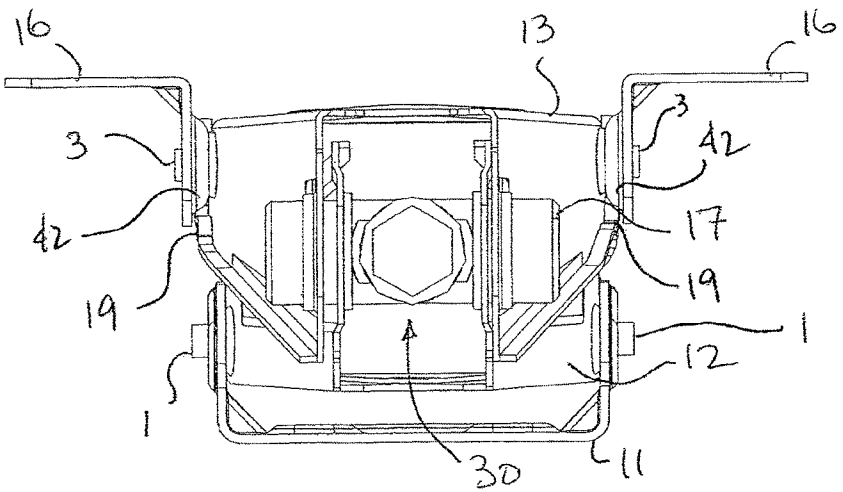
FIG. 5 is an end view of the jack assembly shown in FIG. 2.

A screw-operated jack assembly 10 is shown in FIGS. 1-5. The jack assembly 10 includes a base member 11 for resting the jack assembly 10 against a supporting surface, such as a concrete floor, road surface, or any other desired surface suitable to support the jack assembly 10. A first movable arm member 12 is rotatably connected at a first of its two ends to the base member 11 by a pair of first rivets 1. A second movable arm member 13 is rotatably connected by a first pin or trunnion 17 at a first of its two ends to the second end of the first movable arm member 12. A third movable arm member 14 is rotatably connected at a first of its two ends to the base member 11 by a second pair of rivets 2. A fourth movable arm member 15 is rotatably connected by a second pin or trunnion 18 at a first of its two ends to the second end of the third movable arm member 14. A pair of load supporting brackets 16 are connected by rivets 3 and 4, respectively, to the second ends of the second and the fourth movable arm members 13 and 15 in a manner so that the second and fourth arm members 13 and 15 are rotatable in relation to each of the load supporting brackets 16.

In the illustrated embodiments, each movable arm 12, 13, 14, and 15 forms an open channel having a width extending between a pair of outer sidewalls 12*a*, 13*a*, 14*a*, and 15*a*, respectively. Each arm also has a height generally associated with the height of each sidewall 12*a*, 13*a*, 14*a*, and 15*a*, e.g., corresponding to the distance between the free end of each sidewall 12*a*, 13*a*, 14*a*, and 15*a* and the exterior surface of the closed channel wall 12*b*, 13*b*, 14*b*, and 15*b*, respectively.

The width of each arm 12, 13, 14, and 15, and of each corresponding closed channel wall 12*b*, 13*b*, 14*b*, and 15*b*, tapers such that the width narrows as each arm extends towards a trunnion 17, 18 to which it is connected. These tapered arms 12, 13, 14, and 15 provide improved strength, rigidity, and stability over non-tapered arms. The taper of these arms is evidenced by angle a as exemplarily shown in FIG. 4. It is also understood that each sidewall 12*a*, 13*a*, 14*a*, and 15*a* may be tapered outwardly, or inwardly, as each sidewall extends from the closed channel portion, e.g., from channel wall 12*b*, 13*b*, 14*b*, and 15*b*, to the open channel portion, i.e., to the free edges of sidewalls 12*a*, 13*a*, 14*a*, and 15*a*, of each arm 12, 13, 14, and 15. Strengthening embossments 44 and 48 may also be placed along sidewalls 12*a*, 13*a*, 14*a*, and/or 15*a* to provide additional strength and stability for arms 12, 13, 14, and 15, respectively. Additional strength and stability may also be achieved by placing additional strengthen embossments 46 placed along closed channel walls 12*b*, 13*b*, 14*b*, and/or 15*b*. In the embodiments shown, embossments 44 and 46 extend outwardly from the exterior of upper arms 13 and 15, while embossments 48 extend inwardly along arms 12 and 14. This is because upper arms 13 and 15 overlap lower arms 12 and 14 at trunnions 17 and 18. In other embodiments, other variations of embossments by be employed to achieve similar benefits, which may vary based on the configurations of arms 12, 13, 14, and 15.

Arms 12, 13, 14, and 15 may further include lateral ridges or lips 40 extending along the open channel edges of, and at a bias to, sidewalls 12*a*, 13*a*, 14*a*, and 15*a* to further improve the strength and stability of corresponding arms 12, 13, 14, and 15. In the embodiment shown in the FIGURES, lateral ridges 40 extend inwardly (that is, towards a longitudinal plane extending vertically through the longitudinal centerlines of arms 12, 13, 14 and 15) along lower sidewalls 12*a* and 14*a*, while ridges 40 extend outwardly along upper sidewalls 13*a* and 15*a*.

Because arms 12, 13, 14, and 15 have a tapered width, and because the arms 12, 13, 14, and 15 also include other strengthening features, the height of each arm 12, 13, 14, and 15 is now able to taper in height, whereby the height of each arm is able to decrease as it extends away from each trunnion 17, 18 to which it is connected, without any significant sacrifice in jack strength or stability. This tapering height is most evident in FIG. 3. By providing these tapered height arms, a lower profiled jack having an overall lower collapsed height is achieved.

At the ends of each of the movable arm members 12, 13, 14 and 15, which receive one of the rivets 1, 2, 3 and 4, a plurality of tab-like teeth 19 are provided. As shown in generally FIGS. 1-2, the teeth on opposing ends of the arm members 12, 13, 14 and 15 mesh and permit the load supporting brackets 16 to be raised or lowered as the shaft member 20 is rotated in one direction or the other.

Due to the tapering width of arms 12, 13, 14, and 15, the corresponding teeth 19 of each arm also engage the corresponding base member 11 or bracket 16 at an angle or bias a. This biased engagement of teeth 19, which strengthens and further stabilizes the arrangement and operation thereof, is securely maintained by the use of rivets 1, 2, 3, and 4. Each rivet is independent of the others, meaning that no common shaft extends from one side of jack to the other to be shared by opposing rivets. This arrangement independently secures each plurality of teeth 19 snuggly against the corresponding sidewall of each base member 11 or bracket 16. As a substitute for each rivet, a nut and bolt combination may be independently used in place of each rivet. A lock washer may also be used in conjunction with each nut and bolt combination to further strengthen each attachment.

In the embodiment shown, the teeth 19 of upper arms 13 and 15 are of increasing cross-section (i.e., of variable width), such that as each tooth extends outwardly about each embossment 42, the tooth cross-section increases in width as the depth of each embossment decreases. In the embodiment shown, each variable width tooth 19 is achieved by virtue of extending the ridge 40 associated with each corresponding arm 12, 13, 14, and 15 from each associated sidewall edge to the tooth area. Accordingly, the width of teeth extend outwardly along arms 13 and 15, while the width of teeth 19 associated with arms 12 and 14 extend inwardly as each tooth grows in length. In other embodiments, the variable width teeth may be achieved by other ways known to one of ordinary skill in the art. Variable width teeth 19 provide improved the stability, strength, and durability.

By virtue of these improvements to strengthen arms 12, 13, 14, and 15 of jack assembly 10, the overall height of the jack was reduced. Further, the material used to form the arms was reduced from 13 gauge to 16 gauge steel, which resulted in a substantial reduction in the weight of the jack.

The jack assembly 10 may further include a horizontally extending, rotatable shaft member indicated generally by the numeral 20 in FIG. 1. The rotatable shaft member 20 is provided on its outer circumference with a thread. As shown, the shaft member 20 has a trapezoidal thread, such as a double lead Acme thread, that continuously extends from one end of the shaft member 20 and across approximately two-thirds to three-fourths of the length of the shaft member 20. The shaft member 20 also includes a turning mechanism generally indicated in the drawings by the reference numeral 30 and situated on the end of the unthreaded portion of the rotatable shaft member 20. Each of the trunnions 17 and 18 are provided with a bore that extends perpendicularly through the center portion of the trunnions 17 and 18. In the case of the trunnion 17, the bore provided therethrough is unthreaded and is slightly larger than the diameter of the threaded portion of the shaft member 20. In the case of the trunnion 18, the provided bore is threaded, with a double lead Acme thread, that is dimensionally compatible with the threading provided on the threaded portion of the shaft member 20. As indicated in the drawings, when the jack assembly 10 is in an assembled state, the threaded portion of shaft member 20 is rotatably received by the threaded bore in trunnion 18 and the unthreaded portion of the shaft member 20 is rotatably received by the bore in trunnion 17.

In operation, the jack assembly 10 will cause a load in contact with the load supporting brackets 16 to be raised when a rotation causing tool causes the shaft member 20 to rotate within the threaded bore of the trunnion 18 in a direction that will cause the trunnion 18 to be drawn along the threaded portion toward the trunnion 17. During a typical load-raising process, the jack assembly 10 will first be positioned beneath the load to be lifted such that at least a small clearance space will exist between the load supporting brackets 16 and object to be raised. Next, the shaft member 20 will be turned so that the load supporting brackets 16 make contact with the object and the clearance space is eliminated. As contact is made, load from the object will be increasingly shifted to the load supporting brackets 16 and cause forces to be developed in and transmitted through the second and fourth movable arm members 13 and 15 and the trunnions 17 and 18. The force transmitted through the trunnion 18 will be transferred at the threaded bore to the double lead Acme threads there within. The force transmitted through the trunnion 18 to the Acme threads assumes the form of a frictional force that acts between the opposing Acme thread faces and that increases in magnitude as the load of the object being lifted increases.

Figure 6:
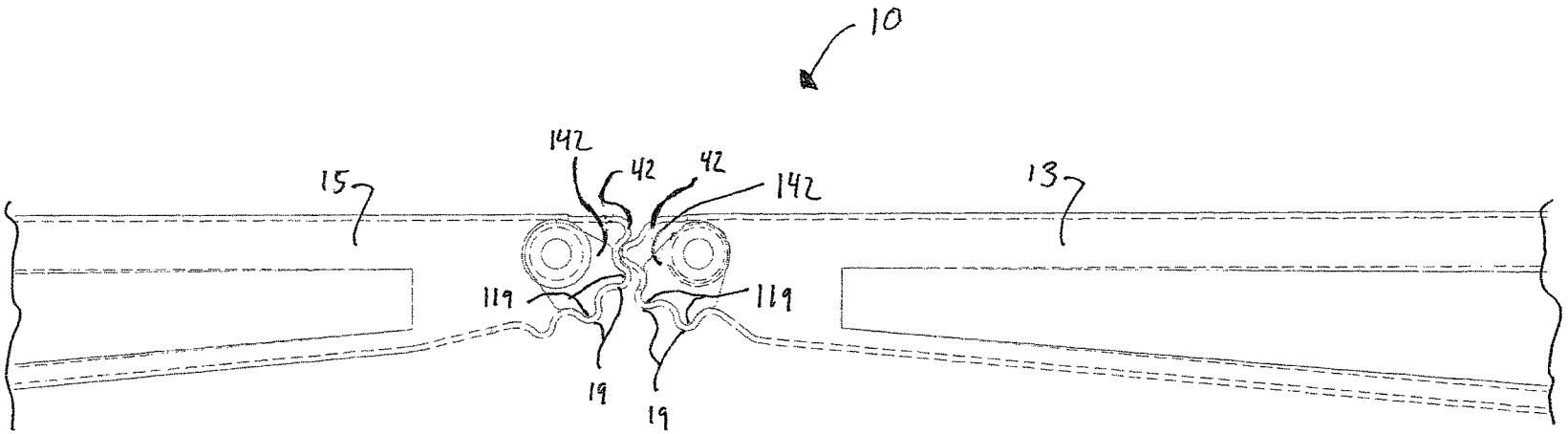
FIG. 6 is a cross-sectional view, as if taken along line 6-6 of FIG. 4, of a jack assembly of another embodiment including optional reinforcement gears.

As best shown in FIG. 6, the jack assembly 10 may includes at least one optional reinforcement gear 142. The reinforcement gear 142 includes reinforcement teeth 119 that generally correspond to the teeth 19 of the embossment 42.

Figure 7:
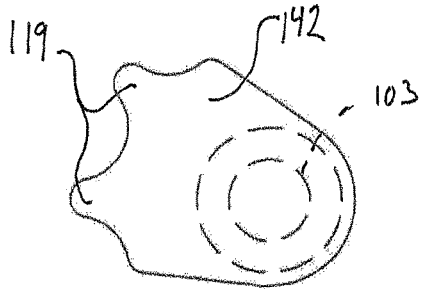
FIG. 7 is a side view of the gear of FIG. 6.
Figure 8:
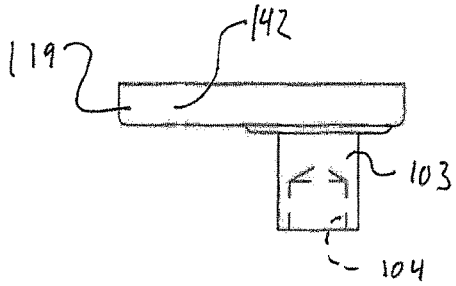
FIG. 8 is a top view of the gear of FIG. 7.

As best shown in FIGS. 7 and 8, the reinforcement gear 142 may include a shaft 103 that may include a shaft bore 104. The shaft bore 104 may engage any of the rivets 1,2, 3, 4, or the shaft 103 may act as a rivet and be flared at the bore 104 upon assembly.

While principles and modes of operation have been explained and illustrated with regard to particular embodiments, it must be understood, however, that this may be practiced otherwise than as specifically explained and illustrated without departing from its spirit or scope.

What is claimed is:

1. A scissor jack assembly comprising:

a base member for resting the jack assembly against a supporting surface;

a support bracket assembly;

first and second lower arm members each of an open channel construction having a width extending between a pair of outer sidewalls, where one end of each lower arm member is connected to said base member;

first and second upper arm members each of an open channel construction having a width extending between a pair of outer sidewalls, where one end of each outer one end is connected to said support bracket assembly;

first and second trunnions connecting said upper arms with said lower arms at ends opposite the base member and the support bracket assembly respectively, each said trunnion including a bore; and, a rotatable shaft member extending into the bores of said first and second trunnions;

wherein each of the upper and lower arm members taper in width as each arm generally narrows in width as each arm extends toward connection with either the first or second trunnion, and wherein each of the upper and lower arm members include one or more strengthening embossments positioned along a ridge extending laterally inwardly from the sidewalls of each of the upper and lower arm members respectively.

2. The scissor jack assembly of claim 1, wherein each of the embossments of the upper and lower arm members include a plurality of teeth located at the end of each such member connecting to said base member or said support bracket assembly, each of the plurality of teeth being angularly biased to a sidewall of the base member or a sidewall of the support bracket assembly to which each arm member is respectfully connected.

3. The scissor jack assembly of claim 2 where the teeth of the each of the embossments of the upper and lower arm members are of varying width.

4. The scissor jack assembly of claim 2, further comprising at least one reinforcement gear having reinforcement teeth corresponding to the teeth of an associated one of said embossments.

5. The scissor jack assembly of claim 4 where at least one of the first and second arms is connected to the support bracket assembly by a shaft of the reinforcement gear.

6. The scissor jack assembly of claim 1 where the first and second arms are connected to the support bracket assembly by at least one rivet.

7. A scissor jack assembly comprising:

a base member for resting the jack assembly against a supporting surface;

first and second lower arm members each of an open channel construction having a width extending between a pair of outer sidewalls, where one end of each lower arm member is connected to said base member;

first and second upper arm members each of an open channel construction having a width extending between a pair of outer sidewalls, wherein each of the upper arm members includes at least one embossments positioned along a ridge extending laterally inwardly from the sidewalls of each of the first and second upper arm members respectively that engage each other;

first and second trunnions connecting said upper arms with said lower arms; and a support bracket assembly where one end of each outer one end is connected to said support bracket assembly.

8. The scissor jack assembly of claim 7, wherein the embossments engage each other proximate to the support bracket assembly.

9. The scissor jack assembly of claim 7, wherein each of the upper and lower arm members taper in width as each arm generally narrows in width as each arm extends toward connection with either the first or second trunnion.

10. The scissor jack assembly of claim 7, wherein each of the embossments include a plurality of teeth located at the end of each upper arm member, the pluralities of teeth engaging each other.

11. The scissor jack assembly of claim 10, wherein each of the plurality of teeth are angularly biased toward a sidewall of the support bracket assembly.

12. The scissor jack assembly of claim 7 where the teeth of the each of the upper arm members are of varying width.

13. The scissor jack assembly of claim 7, further comprising at least one reinforcement gear having reinforcement teeth corresponding to the teeth of an associated one of said embossments.

14. The scissor jack assembly of claim 13 where at least one of the first and second upper arms is connected to the support bracket assembly by a shaft of the reinforcement gear.

15. The scissor jack assembly of claim 7 where the first and second upper arms are connected to the support bracket assembly by at least one rivet.

16. The scissor jack assembly of claim 13 where the first and second upper arms are connected to the support bracket assembly by at least one rivet and the at least one reinforcement gear is mounted to said rivet.

17. A scissor jack assembly comprising:

a base member for resting the jack assembly against a supporting surface;

first and second lower arm members each of an open channel construction having a width extending between a pair of outer sidewalls, where one end of each lower arm member is connected to said base member, wherein each of the lower arm members includes at least one embossments positioned along a ridge extending laterally inwardly from the sidewalls of each of the first and second upper arm members respectively and that engage each other;

first and second upper arm members each of an open channel construction having a width extending between a pair of outer sidewalls;

first and second trunnions connecting said upper arms with said lower arms; and a support bracket assembly where one end of each outer one end is connected to said support bracket assembly.

18. The scissor jack assembly of claim 17, wherein the embossments engage each other proximate to the base member.

19. The scissor jack assembly of claim 17, wherein each of the upper and lower arm members taper in width as each arm generally narrows in width as each arm extends toward connection with either the first or second trunnion.

20. The scissor jack assembly of claim 17, wherein each of the embossments include a plurality of teeth located at the end of each lower arm member, the pluralities of teeth engaging each other.

21. The scissor jack assembly of claim 20, wherein each of the plurality of teeth are angularly biased toward a sidewall of the base member.

22. The scissor jack assembly of claim 17 where the teeth of the each of the lower arm members are of varying width.

23. The scissor jack assembly of claim 17, further comprising at least one reinforcement gear having reinforcement teeth corresponding to the teeth of an associated one of said embossments.

24. The scissor jack assembly of claim 23 where at least one of the first and second lower arms is connected to the base member by a shaft of the reinforcement gear.

25. The scissor jack assembly of claim 17 where the first and second lower arms are connected to the base member by at least one rivet.

26. The scissor jack assembly of claim 23 where the first and second lower arms are connected to the base member by at least one rivet and the at least one reinforcement gear is mounted to said rivet.

* * * * *